US011230301B2

(12) United States Patent
Lewis, II

(10) Patent No.: US 11,230,301 B2
(45) Date of Patent: Jan. 25, 2022

(54) TRANSIT CLEANING UNIT

(71) Applicant: Richard William Lewis, II, Stone Mountain, GA (US)

(72) Inventor: Richard William Lewis, II, Stone Mountain, GA (US)

( * ) Notice: Subject to any disclaimer, the term of this patent is extended or adjusted under 35 U.S.C. 154(b) by 0 days.

(21) Appl. No.: 15/932,753

(22) Filed: Apr. 19, 2018

(65) Prior Publication Data

US 2019/0322295 A1 Oct. 24, 2019

Related U.S. Application Data

(60) Provisional application No. 62/603,504, filed on Jun. 5, 2017.

(51) Int. Cl.

| | |
|---|---|
| ***B61D 35/00*** | (2006.01) |
| ***B61C 3/00*** | (2006.01) |
| ***B61B 13/10*** | (2006.01) |
| ***B08B 9/049*** | (2006.01) |

(52) U.S. Cl.

CPC ..... *B61D 35/00* (2013.01); *B08B 9/0492* (2013.01); *B61B 13/10* (2013.01); *B61C 3/00* (2013.01)

(58) Field of Classification Search

CPC ..... B61D 35/00; B08B 9/0492; B61B 13/10; B61C 3/00; E01H 10/00–007

See application file for complete search history.

(56) References Cited

U.S. PATENT DOCUMENTS 3,826,202 A * 7/1974 Russell-French ..... B61F 5/10 105/182.1
3,895,957 A * 7/1975 Scheel ..... E01C 7/35 134/34
4,203,493 A * 5/1980 Miller ..... E01B 27/107 171/16
4,377,018 A * 3/1983 Cain ..... A47L 11/30 15/321
5,165,139 A * 11/1992 Oxman ..... A47L 11/34 15/321
5,273,059 A * 12/1993 Gross ..... B44D 3/16 134/57 R
5,352,297 A * 10/1994 Peters ..... B05B 12/122 134/15
5,358,568 A * 10/1994 Okano ..... B05B 13/005 118/323
5,601,659 A * 2/1997 Rohrbacher ..... A47L 11/30 134/10
5,707,455 A * 1/1998 Tomita ..... A47L 1/02 134/18
5,715,557 A * 2/1998 Hsu ..... A47L 1/02 15/103
5,911,230 A * 6/1999 Kurz ..... B60S 3/04 134/123

(Continued)

FOREIGN PATENT DOCUMENTS

JP 2003129435 * 5/2003
KR 1004766820000 * 3/2005

(Continued)

*Primary Examiner* — Kevin R Kruer

(57) ABSTRACT

Transit Cleaning Unit is able to clean the walls, overhead, insulators third rail covers and flooring of the subway systems in a minimum amount of time. It provides an effective means of providing a clean environment for the benefit of the customers.

11 Claims, 6 Drawing Sheets

(56) References Cited

U.S. PATENT DOCUMENTS

| | | | | |
|---|---|---|---|---|
| 6,481,448 | B2 * | 11/2002 | Mathieu | B08B 3/026 134/109 |
| 6,866,072 | B2 * | 3/2005 | Kaye | B61D 35/007 141/231 |
| 7,308,900 | B2 * | 12/2007 | Otterson | B08B 3/024 134/172 |
| 8,393,049 | B2 * | 3/2013 | Vogel | E01H 1/103 15/320 |
| 8,597,434 | B2 * | 12/2013 | Barrios | B08B 3/026 134/115 R |
| 9,656,308 | B2 * | 5/2017 | Harman | B08B 9/093 |
| 9,759,174 | B2 * | 9/2017 | Lucas | F02M 63/005 |
| 9,809,950 | B2 * | 11/2017 | Zimmerman | E02F 3/8152 |
| 9,919,333 | B2 * | 3/2018 | Wright | B05B 15/68 |
| 10,214,926 | B2 * | 2/2019 | Lim | B08B 3/024 |
| 2002/0124868 | A1 * | 9/2002 | Rice | B60S 3/006 134/10 |
| 2012/0031440 | A1 * | 2/2012 | Crompton | E01H 1/103 134/104.4 |
| 2012/0152283 | A1 * | 6/2012 | Tiffany | B64F 5/00 134/18 |
| 2012/0255578 | A1 * | 10/2012 | Robinson | B08B 3/024 134/10 |
| 2013/0193231 | A1 * | 8/2013 | Mologousis | B08B 3/024 239/172 |

FOREIGN PATENT DOCUMENTS

| | | | |
|---|---|---|---|
| KR | 1020090002751 | * | 4/2009 |
| KR | 1016622000000 | * | 10/2016 |

* cited by examiner

TRANSIT CLEANING UNIT

CROSS-REFERENCE TO RELATED APPLICATION

This application claims priority under 35 U.S.C. § 119(e) to U.S. Prov. Pat. App. No. 62/603,504, entitled "Transit Cleaning Unit," filed Jun. 5, 2017, now expired.

BACKGROUND

As the need for public transit increases around the world, the requirement to provide a clean environment for the customer is a high priority.

SUMMARY

The transit cleaning unit is designed to clean the walls, overheads, and flooring of the subway systems worldwide. The transit cleaning unit provides an effective means of providing a clean environment for the benefit of the customers.

DETAILED DESCRIPTION

Figure 1:
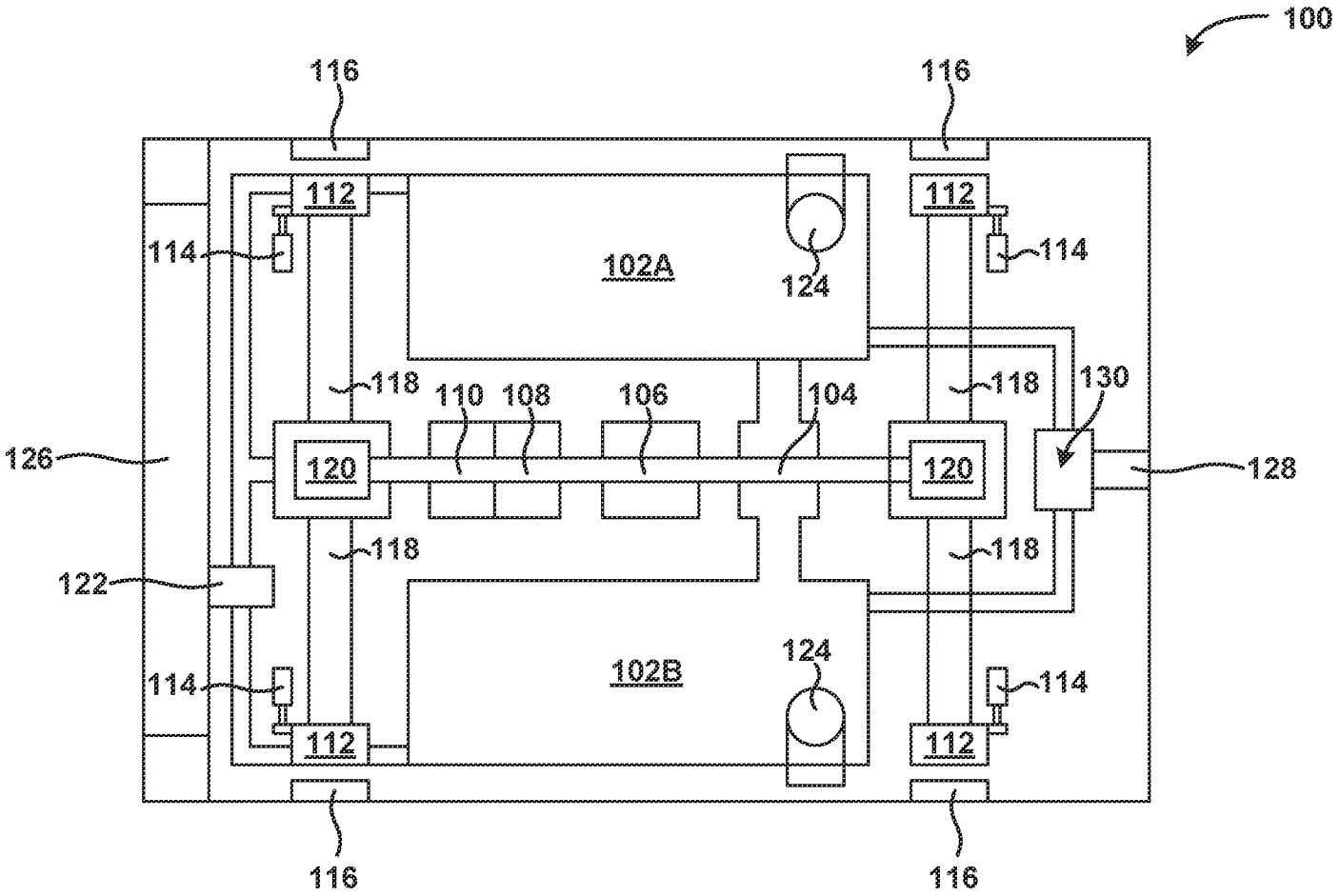
FIG. 1 is a line drawing illustrating a top plan view of the transit cleaning unit, according to one example embodiment of the concepts and technologies disclosed herein.

A transit cleaning unit can provide a means of cleaning the rail transit system maintaining a safe attractive tunnel and station environment. With the twenty-two hour per day schedule that is used in many cities, the allotted three hours does not provide adequate time in which to properly clean the needed areas. The ideal configuration is to have two working cars and two supply cars to enable more coverage. This approach will enable the crew operating the transit cleaning unit to complete the travel on one line in one direction and then at the end of the line, to operate the transit cleaning unit going on the other line facing the opposite direction.

During the three hours between operations, the transit cleaning unit may be utilized to operate. The transit cleaning unit can also be operated when single tracking is enforced during weekends and holidays. The transit cleaning unit is designed to provide a time saving means of cleaning the tunnel systems of the subways worldwide. The transit cleaning unit is able to clean the walls, overhead, flooring and insulators of the subway systems in a minimum amount of time.

The solenoid activated nozzles are controlled by a PLC that can accommodate the different modes of station locations, wall construction as in isolating nozzles when approaching station platforms. The first concept of the transit cleaning unit is a remolded transit rail car converted to the specifications outlined and is self-propelled by existing power from the third rail. It is also been observed that the cleanliness of the space between the rails in the stations is not acceptable. The requirement for a means to clean the insulators on the systems has been requested by the chief engineer of one of the major rail transit systems in the United States.

A transit cleaning unit is able to clean the walls, overhead, insulators third rail covers and flooring of the subway systems in a minimum amount of time. The transit cleaning unit is a rail car converted to the specifications outlined. The transit cleaning unit is self-propelled and systems are powered by third rail. The transit cleaning unit is programed through a PLC. In order to accomplish the most effective means of cleaning, it is recommended that the transit authority purchase two work cars and two supply cars. This will enable operations to continue when the cars come to the end of a certain line and return on the opposite track.

The transit cleaning unit utilizes a 5,000 pound per square inch ("PSI") water pressure to remove the harmful dirt that gathers in the tunnels of the rail transit system. With the rise in commuters using the rail system on an increased rate, the transit cleaning unit will provide a safer environment in which the customers are not breathing the harmful particles from the accumulation of dirt on the overheads, walls, decking. The transit cleaning unit also provides a means of cleaning the insulators for the third rail system reducing down time due to maintenance and replacement.

Referring to FIG. 1, a line drawing illustrating a top plan view of a transit cleaning unit 100 will be described, according to one example embodiment of the concepts and technologies disclosed herein. As shown in FIG. 1, the transit cleaning unit 100 can include multiple water supply tanks 102A-B (hereinafter collectively and/or generically referred to as "water supply tanks 102"), a three-way supply fitting 104, a main pump 106, an on-demand hot water heater 108, a 5,000 PSI pressure washer 110, multiple water nozzles/frames 112, multiple hydraulic actuating cylinders 114, multiple sequence/micro switch doors 116, multiple flexible hoses 118, a six-way selector valve 120, a hydraulic system 122, multiple fill ports 124, an operator station 126, a supply line 128 from a supply car, and a three-way fitting 130.

Figure 2:
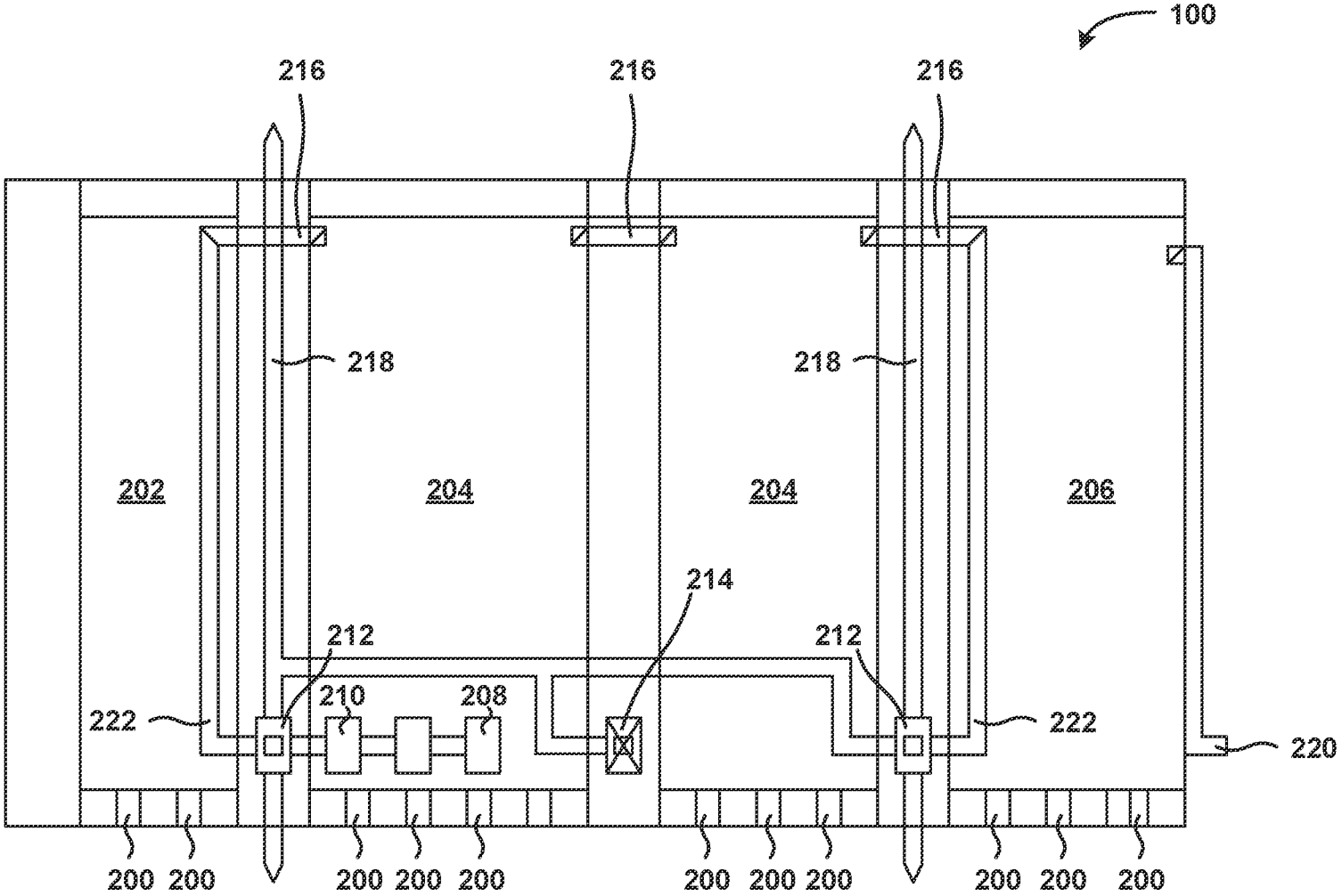
FIG. 2 is a line drawing illustrating a top plan view showing placement of the components of the transit cleaning unit, according to one example embodiment of the concepts and technologies disclosed herein.

Turning now to FIG. 2, a line drawing illustrating a top plan view showing placement of the components of the transit cleaning unit 100 will be described. In particular, FIG. 2 illustrates placement of the components of the transit cleaning unit 100. As shown in FIG. 2, the transit cleaning unit 100 can include multiple water tank supports 200, which can be configured to support the water supply tanks 102 and/or other tanks; a forward supply tank 202; one or more middle supply tank 204; an aft supply tank 206; a main pump washer 208; a 5,000 PSI pressure washer 210; a six-way selector valve 212; an insulator cleaner valve 214; tank return connecting piping 216; one or more overhead decking piping nozzles 218; one or more supply lines 220; and one or more relief return line 222. According to some embodiments, in order to utilize the maximum amount of water, the transit cleaning unit 100 can include installation of a tank forward of the forward doors and aft of the aft doors. On many cars there is a station at the aft end of the car. This area can best serve to place another tank in.

Figure 3:
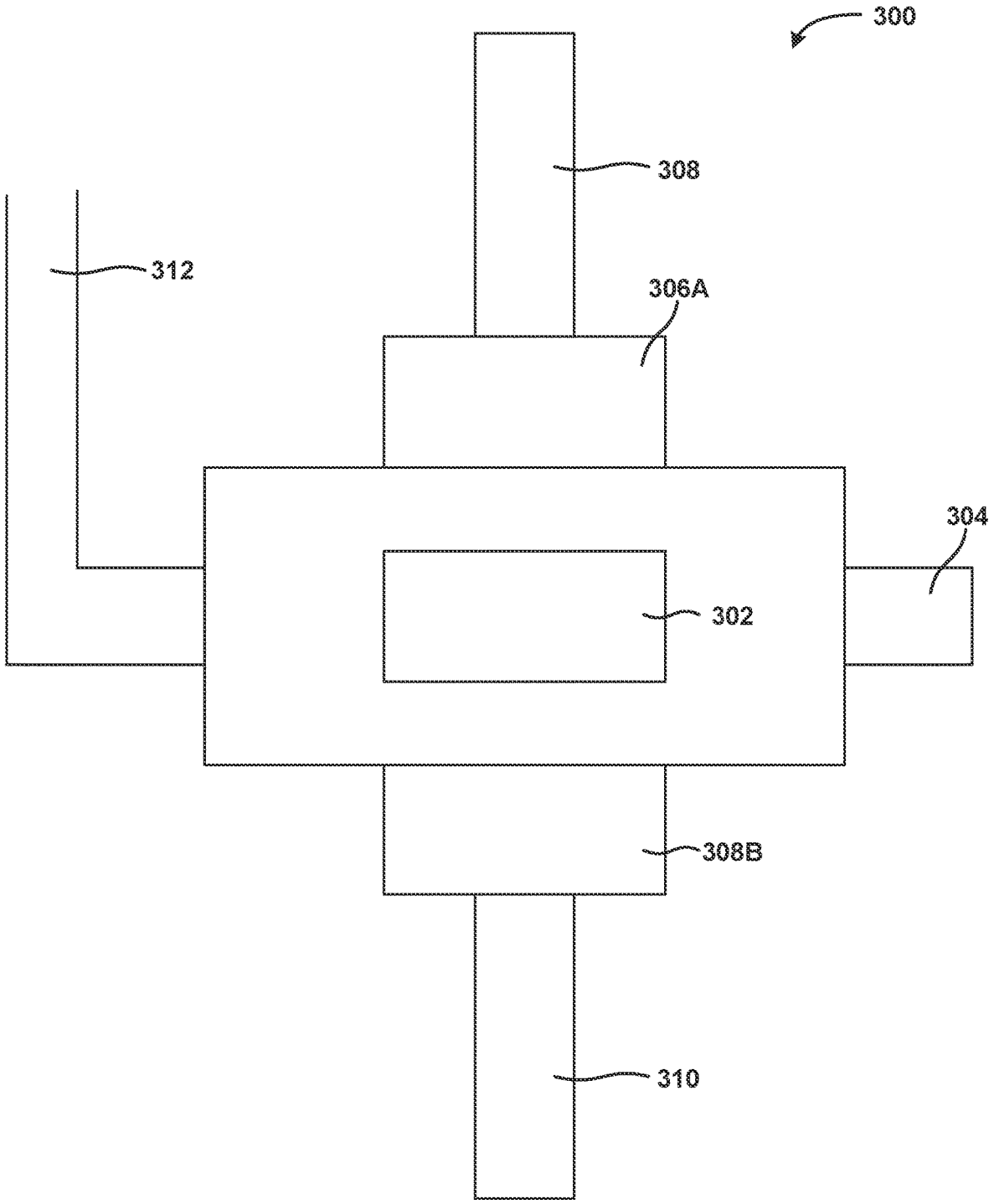
FIG. 3 is a line drawing illustrating a six-way directional valve for use in association with the transit cleaning unit, according to one example embodiment of the concepts and technologies disclosed herein.

Turning now to FIG. 3, a line drawing illustrating a six-way directional valve 300 for use in association with the transit cleaning unit 100 will be described, The six-way directional valve 300 can include a solenoid controlled and activated, PLC-controlled selector valve. The six-way directional valve 300 can be configured to receive a 5,000 PSI water supply from the 5,000 PSI pressure washer 110, 210; and can be configured to direct the flow to the overhead, decking, wall, and insulator cleaners. A pressure valve can be installed in the return line to allow the water to return to the supply tank 202, 204, 206 when not being directed to the various nozzles 218. Via a two way fitting, the six-way directional valve 300 can also be configured to direct the flow to the rear six-way directional valve. A pressure valve can also be installed in the rear directional valve 300 to permit water to return to the supply tank 202, 204, 206 when not being directed to the various nozzles 218.

As shown in FIG. 3, the six-way directional valve 300 can include a solenoid-controlled wall nozzle access valve 302. The solenoid-controlled wall nozzle access valve 302 can provide/block access to the wall nozzles. A similar valve can be located on the other side of the six-way directional valve 300, though this is not visible in FIG. 3. The six-way directional valve 300 also can include (or can be coupled or connected to) piping 304, which can be used to pipe water from an on-demand water heater and/or pump to the six-way directional valve 300.

As shown in FIG. 3, the solenoid-controlled overhead nozzle access valve 306A and the solenoid-controlled flooring nozzle access valve 306B can provide/block access to the overhead and flooring nozzles.

As shown in FIG. 3, the six-way directional valve 300 includes overhead piping 308. The overhead piping 308 includes piping to one or more overhead nozzles. The six-way directional valve 300 also includes flowing piping 310. The flowing piping 310 includes piping to one or more flowing nozzles. The six-way directional valve 300 also includes a return 312. The return 312 can be used to return water to the supply tanks 204, 202, 206.

Figure 4:
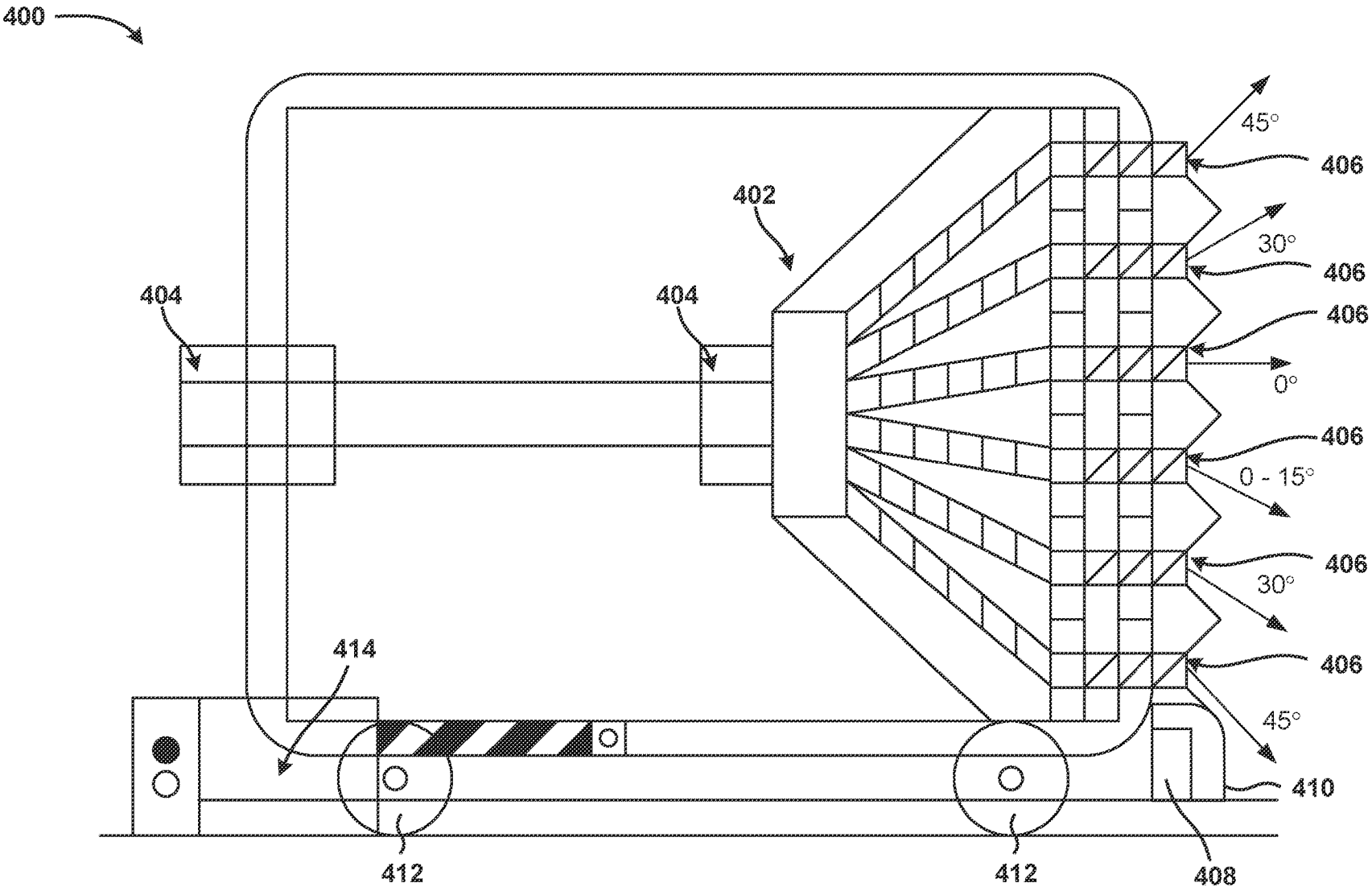
FIG. 4 is a line drawing illustrating a side elevation view of a high pressure nozzle manifold and frame for the transit cleaning unit, according to one example embodiment of the concepts and technologies disclosed herein.

Turning now to FIG. 4, a line drawing illustrating a side elevation view of a high pressure nozzle manifold and frame 400 for use in association with the transit cleaning unit 100 will be described, according to one example embodiment of the concepts and technologies disclosed herein. According to various embodiments of the concepts and technologies disclosed herein, the high pressure nozzle manifold and frame 400 can include a nozzle manifold 402, which can be connected to a supply line via one or more nozzle manifold fittings 404. As shown in the illustrated embodiment, the nozzle manifold 402 can include one or more nozzles 406. According to various embodiments of the concepts and technologies disclosed herein, the nozzles 406 can be configured to spray high pressure/heated water at various angles as depicted in FIG. 4. In the illustrated embodiment, the nozzles 406 are arranged (from top to bottom) at forty five, thirty, zero, between zero and negative fifteen, negative thirty, and negative forty five degree angles.

As shown in FIG. 4, the high pressure manifold and frame 400 is mounted at forward and aft wall doors of the transit cleaning unit 100. In FIG. 4, the third rail 408 and third rail cover 410 are visible. In some embodiments, the high pressure manifold and frame 400 can include nozzle frame wheels 408, and can include a hydraulic actuating cylinder ("hydraulic actuator") 414. In particular, the high pressure manifold and frames 400 is attached to the hydraulic actuator 414, which receives commands from a programmable logic controller ("PLC"), thereby instructing the high pressure manifold and frame 400 as to when to extend and retract. In some embodiments, the top and bottom nozzles 406 can be angled to meet the spray pattern of the overhead and decking nozzles. It should be understood that this example is illustrative, and therefore should not be construed as being limiting in any way.

In some embodiments of the concepts and technologies disclosed herein, the high pressure manifold and frame 400 can be fed (e.g., via the supply lines and the nozzle manifold fittings 404) from one of the supply cars. The tanks in the supply car can run the entire length of the supply car, from the forward doors to the aft doors, in some embodiments. Due to the restriction of the door dimensions in order to allow access to the cars, the tanks can be constructed in some embodiments to be mounted on the sides of the car.

Figure 5:
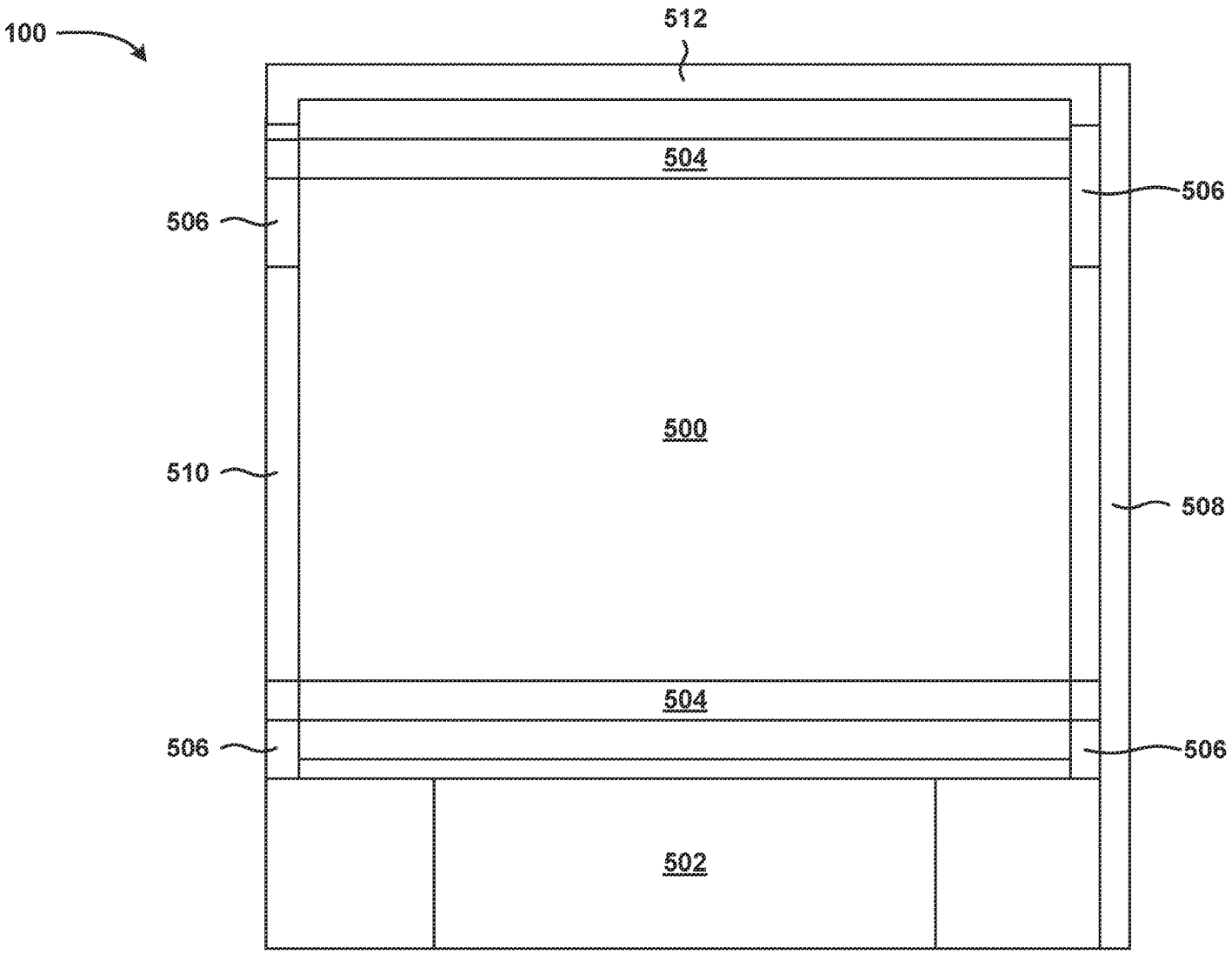
FIG. 5 is a line drawing illustrating a front elevation view of the water tank securing straps of the transit cleaning unit, according to one example embodiment of the concepts and technologies disclosed herein.

Turning now to FIG. 5, a line drawing illustrating a front elevation view of the transit cleaning unit 100 is shown to illustrate water tank security straps for use in association with the transit cleaning unit 100 will be described, according to one example embodiment of the concepts and technologies disclosed herein.

Figure 6:
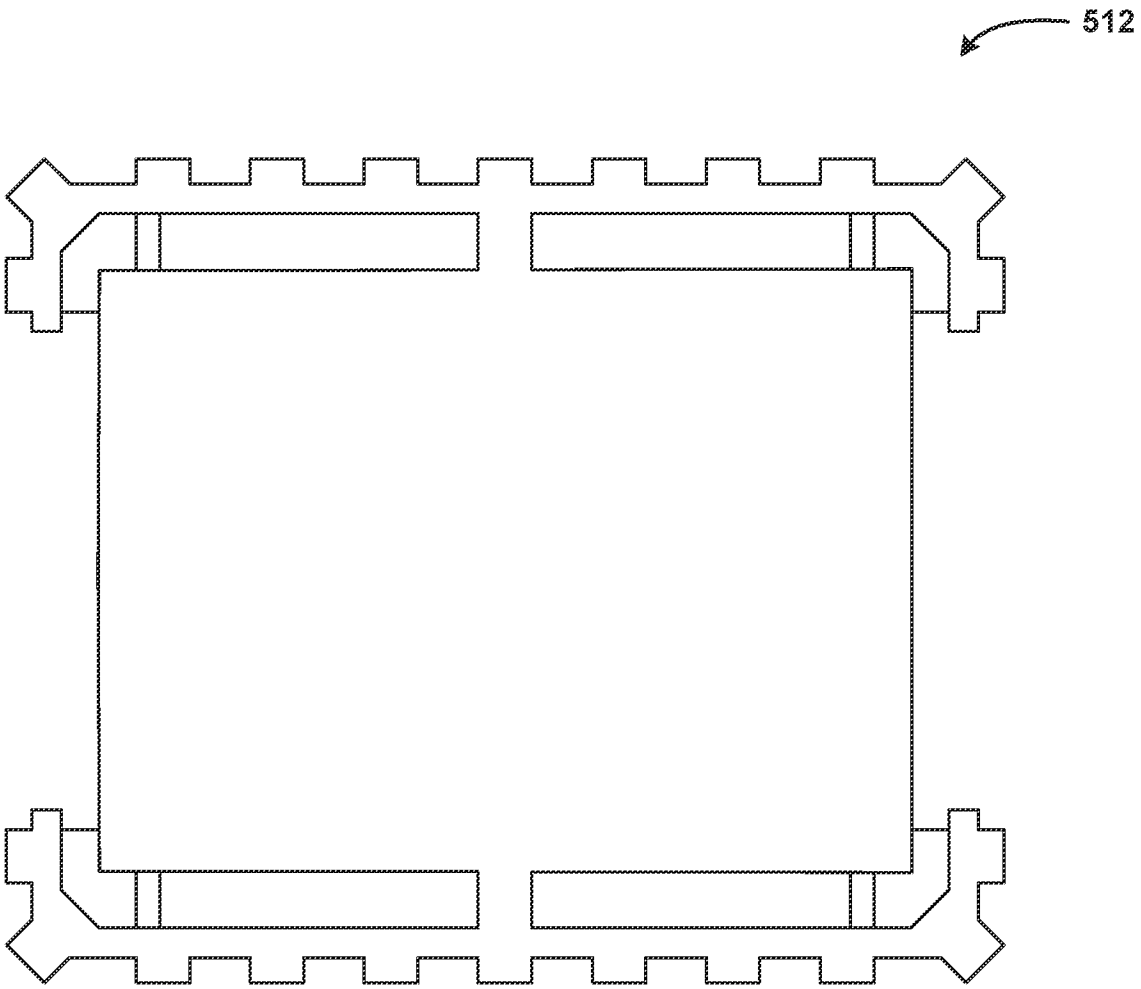
FIG. 6 is a line drawing illustrating the overhead and decking nozzles on the work car of a transit cleaning unit, according to one illustrative example of the concepts and technologies disclosed herein.

According to various embodiments of the concepts and technologies disclosed herein, as can be seen in the view shown in FIG. 5, the supply tank 500 can be located above decking support 502. Water tank securing straps 504 can be included. Cushions 506 also can be located around the supply tank 500 and the water tank securing straps 504 can be secured to one or more handrails 508. Also visible in FIG. 5 are the car walls 510 and the car overhead 512. An example of the car overhead 512 is shown in FIG. 6. As can be seen from the overhead 512 shown in FIG. 6, the end nozzles can be angled to meet the wall nozzles. It should be understood that these examples are illustrative, and therefore should not be construed as being limiting in any way.

In practice, water supply tanks are mounted on each side of a car internally. A three-way "T" fitting supplies a supply of water to the electric powered pump. The electric powered pump, mounted on the car flooring, supplies water to the electric powered on-demand hot water heater, which can be mounted on the car flooring. An electric powered on-demand hot water heater provides hot water to the high pressure washer. The 5,000 PSI high pressure water washer, mounted on the car flooring, receives hot water from the on-demand hot water heater to supply to the high pressure nozzles mounted on the track frames, which can be located on each side of the car.

A movable frame, mounted on the car flooring and including four ball bearing wheels, can house the high pressure nozzles that can deliver high pressure hot water to the walls. High pressure (5,000 PSI) nozzles can be mounted on the movable frame. A 3,000 PSI balanced double acting actuating cylinder mounted on the car flooring, and mounted to the nozzle frame, can provide extend/retract movement. Sequence micro-switches are mounted on the doors sending signals to the servo valves controlling the actuating cylinders. The transit cleaning unit 100 also can include flexible hoses, a four-way fitting, a hydraulic system, fill ports, and an operator station. The transit cleaning unit 100 operation can be controlled by a PLC. The programming of the PLC can be activated by light/laser sensors mounted on the work car.

In various embodiments, piping can route from the work car, through the car decking under the supply tanks, and forward of the middle doors that are non-operational. The hydraulic motor can enable the spring loaded actuator to extend and retract the piping and the cleaner for transport to the work site. The hydraulic motor will also enable one side of the car to retract the insulator cleaner when entering a station, and allowing the side that has the insulators too continue with the cleaning process. The hydraulic system for the hydraulic motor is mounted next to the middle doors on the work car. It is also connected to the PLC unit and operated through the laser sensors on the car alerting the motor to power on and off when approaching or leaving a station. The distance from the insulator to the inside nozzle piping must allow to operate with the grounding brackets installed. An option is to have the bottom of the piping have a "t" fitting installed to permit 45 degree nozzles installed to clean the fore and aft portions of the insulators. The piping can be either one inch or three-quarters of an inch in diameter. Installing the nozzles is to drill and tap the piping.

What is claimed:

1. A four car transit cleaning unit comprising:

two supply cars; and two work cars located on either end of said two supply cars, wherein each of the two supply cars comprises a converted transit car comprising forward doors, aft doors, and four water tanks, wherein a first water tank of the four water tanks is positioned forward of the forward doors, wherein a second water tank of the four water tanks is positioned aft of the aft doors, wherein a third water tank of the four water tanks and a fourth water tank of the four water tanks are positioned between the forward doors and aft doors, wherein each of the two work cars comprises a roof, an undercarriage, a floor, forward doors, aft doors, a non-operational middle door, high pressure water nozzles, a five-thousand PSI pressure washer that supplies water to the high pressure water nozzles, and an on-demand hot water heater that supplies water to the pressure washer, wherein the high pressure water nozzles in each of the two work cars comprises overhead high pressure water nozzles on the roof, decking high pressure water nozzles located on the undercarriage, wall high pressure water nozzles mounted at the forward doors and the aft doors on a hydraulically moveable frame allowing the wall high pressure water nozzles to extend and retract along the floor, and an insulator high pressure water nozzle mounted under the middle door, which can hydraulically extend and retract.

2. The four car transit cleaning unit of claim 1, further comprising a water pump that supplies water to the on-demand water heater.

3. The four car transit cleaning unit of claim 2, further comprising a water supply line that supplies water to the on-demand water heater.

4. The four car transit cleaning unit of claim 1, further comprising a six-way directional valve.

5. The four car transit cleaning unit of claim 4, wherein the six-way directional valve comprises a solenoid-controlled water nozzle access valve.

6. The four car transit cleaning unit of claim 1, wherein the four car transit cleaning unit is powered by a third rail of a subway system.

7. A system comprising:

a subway system; and a four car transit cleaning unit comprising two supply cars and two work cars located on either end of said two supply cars, wherein each of the two supply cars comprises a converted transit car comprising forward doors, aft doors, and four water tanks, wherein a first water tank of the four water tanks is positioned forward of the forward doors, wherein a second water tank of the four water tanks is positioned aft of the aft doors, wherein a third water tank of the four water tanks and a fourth water tank of the four water tanks are positioned between the forward doors and aft doors, wherein each of the two work cars comprises a roof, an undercarriage, a floor, forward doors, aft doors, a non-operational middle door, high pressure water nozzles, a five thousand PSI pressure washer that supplies water to the pressure water nozzles, and an on-demand water heater that is configured to supply heated water to the pressure washer, wherein the high pressure water nozzles in each of the two work cars comprises overhead water nozzles on the roof, decking water nozzles located on the undercarriage, wall water nozzles mounted at the forward doors and the aft doors on a hydraulically moveable frame allowing the wall water nozzles to extend and retract along the floor, and a water nozzle mounted under the middle door, which can hydraulically extend and retract.

8. The system of claim 7, further comprising a water pump that supplies water to the on-demand water heater.

9. The system of claim 8, further comprising a water supply line that supplies water to the on-demand water heater.

10. The system of claim 7, further comprising a six-way directional valve, wherein the six-way directional valve comprises a solenoid-controlled water nozzle access valve.

11. The system of claim 7, wherein the transit cleaning unit is powered by a third rail of the subway system.

* * * * *